United States Patent [19]

Toya et al.

[11] Patent Number: 4,924,102

[45] Date of Patent: May 8, 1990

[54] APPARATUS FOR GENERATING NEGATIVELY CHARGED SPECIES

[75] Inventors: Hideaki Toya; Hiroyuki Sasao; Tatsuya Hayshi, all of Amagasaki, Japan

[73] Assignee: Mitsubishi Denki Kabushiki Kaisha, Japan

[21] Appl. No.: 279,801

[22] Filed: Dec. 5, 1988

[30] Foreign Application Priority Data

| | | | |
|---|---|---|---|
| Dec. 25, 1987 | [JP] | Japan | 62-326850 |
| May 10, 1988 | [JP] | Japan | 63-111467 |
| Jul. 26, 1988 | [JP] | Japan | 63-184643 |

[51] Int. Cl.[5] ..... H01J 3/04

[52] U.S. Cl. ..... 250/426; 250/423 R; 313/231.41

[58] Field of Search ..... 250/426, 423 R, 423 P; 313/231.41; 315/111.81

[56] References Cited

U.S. PATENT DOCUMENTS

| | | | |
|---|---|---|---|
| 3,323,002 | 5/1967 | Lafferty | 313/231.41 |
| 3,356,897 | 12/1967 | Barr | 313/231.41 |
| 3,465,192 | 9/1969 | Lafferty | 313/231.41 |
| 4,458,180 | 7/1984 | Sohval | 313/213.41 |
| 4,490,651 | 12/1984 | Taylor et al. | 250/423 P |
| 4,587,430 | 5/1986 | Adler | 250/423 R |
| 4,721,889 | 1/1988 | Seidel et al. | 250/423 R |

OTHER PUBLICATIONS

Van Os et al., "The Role of Cesium-ion Bombardment in the Formation of Negative Hydrogen Ions on a Converter Surface", J. Appl. Phys. 61 (11), 6/1/87.

*Primary Examiner*—Bruce C. Anderson

*Attorney, Agent, or Firm*—Leydig, Voit & Mayer

[57] ABSTRACT

An apparatus for generating negatively charged species has a cathode and an anode which are disposed in a vacuum vessel facing each other. A constricted arc having a sufficiently large arc current is generated in an arc space between the anode and the cathode, thereby generating negatively charged species of various types of metals, semiconductors, and gases.

22 Claims, 9 Drawing Sheets

APPARATUS FOR GENERATING NEGATIVELY CHARGED SPECIES

BACKGROUND OF THE INVENTION

1. Field of the Invention

The present invention relates to an apparatus for generating negatively charged species using an arc discharge.

2. Statement of the Related Art

FIG. 1 is a schematic diagram of a conventional apparatus for generating negatively charged species which is disclosed in the *Journal of Applied Physics*, Vol. 61, No. 11, pp. 5,000–5,011, 1 June 1987. In FIG. 1, a cesium reservoir 1 is disposed in a vacuum vessel (not shown), and first and second hollow cathodes 2, 3 are arranged in horizontally symmetrical positions relative to the cesium reservoir 1. A coil having an overall U-shaped configuration is disposed between the first and second hollow cathodes 2, 3. A disk-shaped converter 5 communicating with the cesium reservoir 1 for exchanging charges is provided in a central portion of the coil 4. A disk-shaped anode 6 is provided in a face-to-face relationship with this converter 5. This anode 6 communicates with the inside of a negatively charged ion detector 7 through a central hole 6*a* thereof. In addition, an ignition electrode 8, opposed to the first hollow cathode 2, has a tip portion thereof placed inside the coil 4.

A description will now be made of the operation of the above-described apparatus for generating a negatively charged species. First, a high voltage is applied between the first hollow cathode 2 and the ignition electrode 8 located at a position 8*a* indicated by a dotted line, thereby starting a discharge. Subsequently, as the ignition electrode 8 is retracted to the position indicated by the solid line, an arc discharge takes place between the anode 6 and the first hollow cathode 2 to which a high voltage is being applied. In addition, an arc discharge also takes place between the second hollow cathode 3 and the anode 6, and a U-shaped arc discharge is formed between the first hollow cathode 2 and the second hollow cathode 3. Incidentally, after the inside of the vacuum vessel is thoroughly evacuated, hydrogen, argon or the like is admitted to the vacuum vessel until the pressure therein reaches $10^{-3}$ to several mm Hg or thereabouts.

Subsequently, as the cesium reservoir 1 is heated, cesium in the cesium reservoir evaporates, and the evaporated cesium vapor is released through a hole (not shown) formed in the converter 5. Hence, the surface of the converter 5 is covered with the cesium vapor. Furthermore, when hydrogen cations collide with the negative biased converter 5, and hydrogen cations and cesium cations collide with hydrogen atoms adsorbed on the surface of the converter, the hydrogen cations and hydrogen atoms exchange charges with the cesium vapor on the surface of the converter 5 and are thereby converted into hydrogen anions. These hydrogen anions are introduced into the negatively charged ion detector 7 through the hole 6*a* of the anode 6 and are thereby detected.

Since the conventional apparatus for generating a negatively charged species is arranged as described above, the converter 5 and the cesium reservoir 1 must be provided, and a heater for evaporating cesium must be used. Hence, there have been drawbacks in that the structure is complicated, and the negatively charged species so generated are confined to a gas such as hydrogen or argon.

SUMMARY OF THE INVENTION

Accordingly, an object of the present invention is to provide an apparatus for generating a negatively charged species which does not require a converter, a cesium reservoir or the like and is capable of generating a negatively charged species of a gas with a simple arrangement and is also capable of generating a negatively charged species of a metal and a semiconductor, thereby overcoming the above-described drawbacks of the conventional art.

To this end, the present invention provides an apparatus for generating a negatively charged species, comprising: a vacuum vessel; an anode disposed in the vacuum vessel; an cathode disposed in the vacuum vessel facing the anode; and an arc power source for generating a constricted arc having a large arc current between the anode and the cathode, thereby generating a negatively charged species in the space between the anode and the cathode.

In this invention, since a constricted arc is formed between an anode and a cathode, a negatively charged species of a metal, a semiconductor or a gas is generated in the arc space between the anode and the cathode.

DESCRIPTION OF THE PREFERRED EMBODIMENTS

Figure 1:
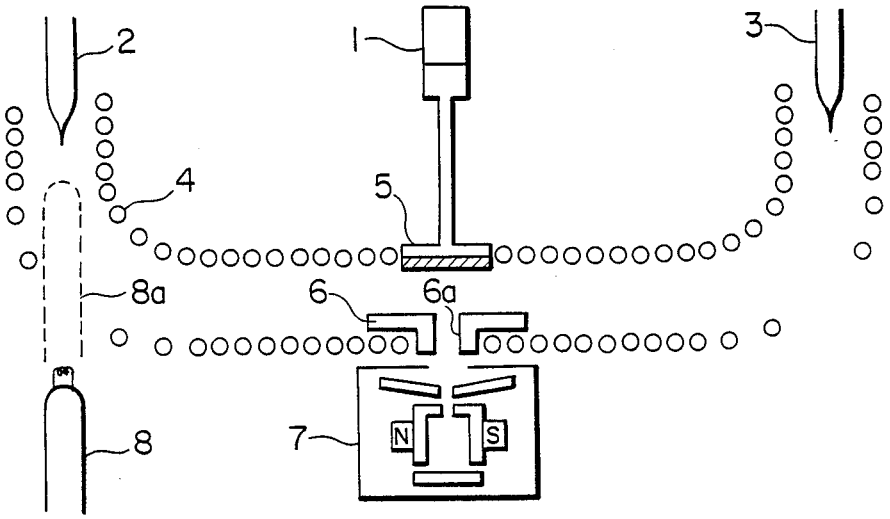
FIG. 1 PRIOR ART
FIG. 1 is a schematic view of a conventional apparatus for generating a negatively charged species.
Figure 2:
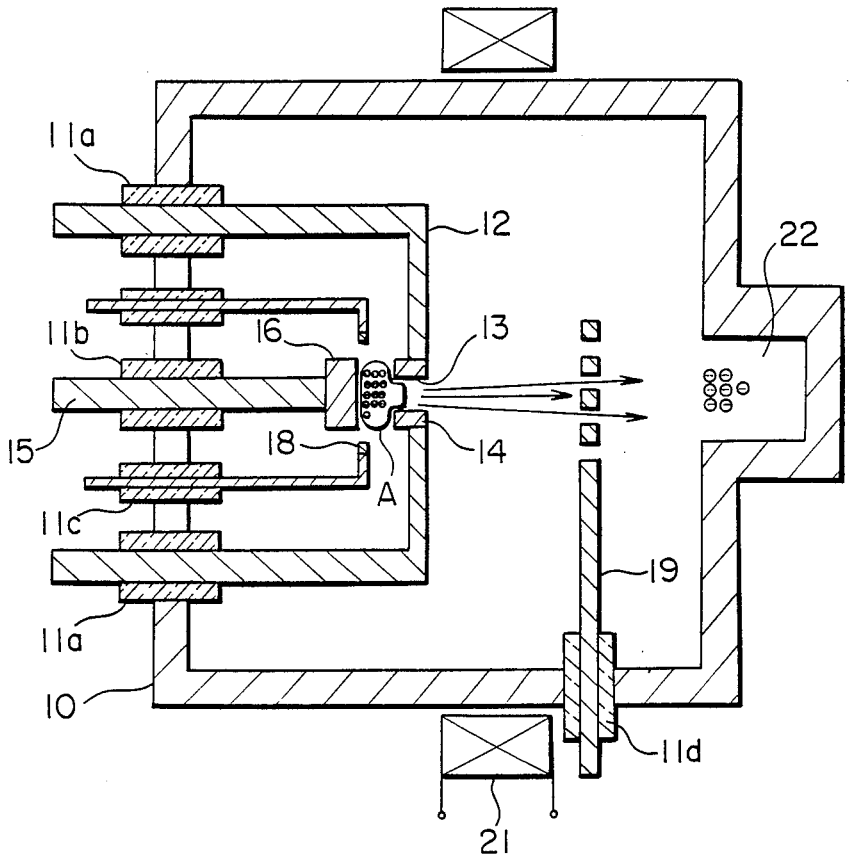
FIG. 2 is a schematic view of an apparatus for generating a negatively charged species in accordance with an embodiment of the present invention.
Figure 3:
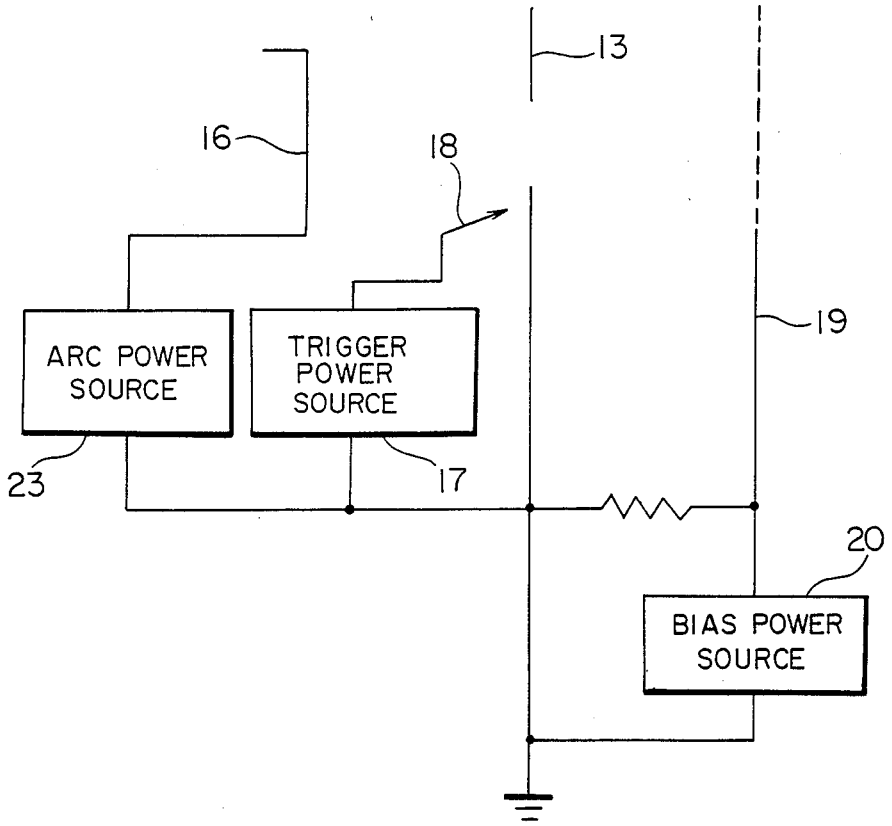
FIG. 3 is a circuit diagram of the apparatus shown in FIG. 2.

Referring now to the accompanying drawings, a description will be given of the embodiments of the present invention. FIG. 2 shows a schematic view of an apparatus for generating a negatively charged species in accordance with an embodiment of the present invention, while FIG. 3 shows a circuit diagram of the apparatus shown in FIG. 2. In these drawings, an electrically conductive member 12 having a cylindrical shape including a bottom is supported by an insulating support member 11*a* mounted in a box-shaped vacuum vessel 10. Vessel 10 may be evacuated to $10^{-6}$ to $10^{-7}$ mm Hg or thereabouts. A copper cathode 14 is installed centrally in the bottom of the conductive member 12. A hole 13 for the passage of the negatively charged species is disposed in the center of this cathode 14. This cathode 14 is opposed to a copper anode 16 which is installed at the tip of a rod 15, penetrating and supported by an insulating support member 11*b* in the vacuum vessel 10. A trigger electrode 18 connected to a trigger power source 17 extends from a wall surface of the vacuum vessel 10 and is supported by means of an insulating support member 11*c*. The trigger electrode 18 is cylindrical and includes a bottom having a central opening adjacent anode 16. The trigger electrode is disposed within conductive member 12. An arc space A lies between the anode 16 and the cathode 14.

A grid 19 for attracting negatively charged species from the arc space A toward the grid 19 is disposed in the vacuum vessel 10 and supported by means of an insulating support member 11*d*. The grid 19 is connected to a bias power source 20 for applying a bias voltage to the grid 19. A coil 21 is provided around the vacuum vessel 10 to converge the negatively charged species flowing toward grid 19 by producing a magnetic field between the cathode 14 and the grid 19. A negatively charged species accumulating section 22 having a concave shape is formed on a side wall surface of the vacuum vessel 10 opposite and on the opposite side of the grid 19 from cathode 14.

A description will now be given of the operation of the apparatus for generating negatively charged species in accordance with the present invention. First, a high voltage is applied between the cathode 14 and the trigger electrode 18 by using the trigger power source 17 to cause a discharge to take place. An arc discharge takes place between the anode 16 and the cathode 14 as a result of this discharge. When an arc current supplied from an arc power source 23 connected to the cathode 14 and the anode 16 is small (this arc is generally called a diffuse arc), negatively charged species of the copper of the anode 16 and the cathode 14, e.g. copper anions, do not occur in the arc space.

However, it was found through a study conducted by the present inventors that when the arc current is sufficiently large, and the amount of copper vapor and copper cations generated from the anode 16 becomes greater than the amount of copper vapor and copper anions generated from the cathode 14 (the arc of this form is generally called a constricted arc), copper anions having negative charges are generated in the arc space. In other words, cations are converted into anions because cations generated from the anode collide with anions, causing an exchange of charges to take place.

For instance, copper anions having negative charges were generated in the arc space when copper having an outer diameter of 20 mm was used as the anode 16 and the cathode 14, a gap length between the anode 16 and the cathode 14 was set at 4 mm, and a current of 10–20 kA was supplied as an arc current. Thus, with respect to the copper anions generated between the anode 16 and the cathode 14, if a positive bias voltage is applied to the grid 19 relative to the cathode 14, the copper anions, i.e., the negatively charged species, can be readily transported from the arc space A through the hole 13 formed in the cathode 14 for the passage of the negatively charged species. In addition, the negatively charged species thus transported through the grid 19 accumulate in the negatively charged species accumulating section 22.

Figure 4:
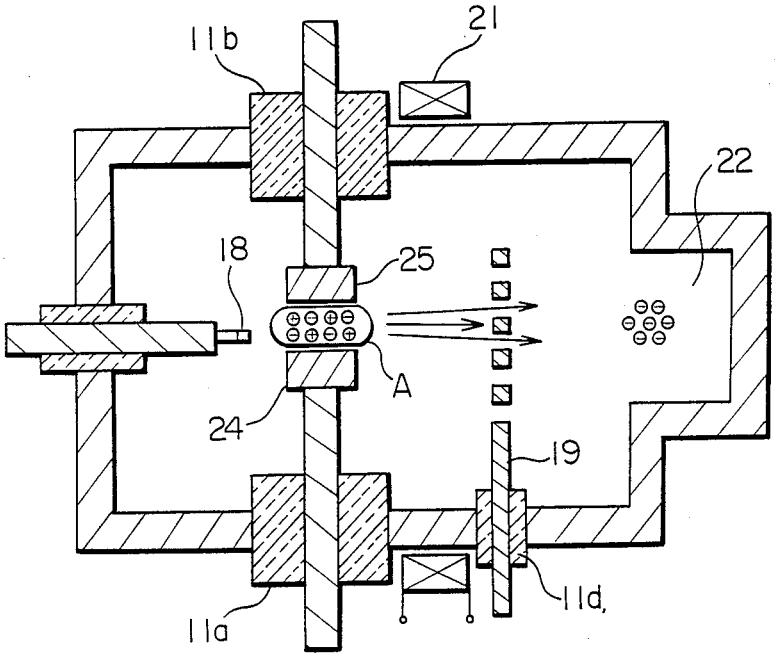
FIG. 4 is a schematic view of an apparatus for generating an negatively charged species in accordance with another embodiment of the present invention.

Although, in the above-described embodiment, an arrangement is shown in which the hole 13 for the passage of the negatively charged species is provided in the cathode 14 to transport the negatively charged species, a hole for the passage of the negatively charged species may be provided in the anode 16 to transport the negatively charged species. In addition, as shown in FIG. 4, an arrangement may be provided such that the hole for the passage of the negatively charged species is provided in neither a cathode 24 nor an anode 25, and the negatively charged species may be drawn out directly from the arc space.

Although, in the above-described embodiment, an example has been shown in which copper is used as the tubular cathode and the bar-like anode, it is possible to use another metal such as titanium, aluminum, chromium, zirconium, molybdenum, tantalum, tungsten, lead, silver, or gold, or a semiconductor such as silicon or germanium. For these metals or semiconductors, an identical material may be used for both the anode and the cathode, or different metals or semiconductors may be used for the anode and the cathode. In addition, if a metal such as titanium in which a gas such as hydrogen or argon is occluded is used for the anode and/or the cathode, it is possible to generate negative ions of the gas.

Figure 5:
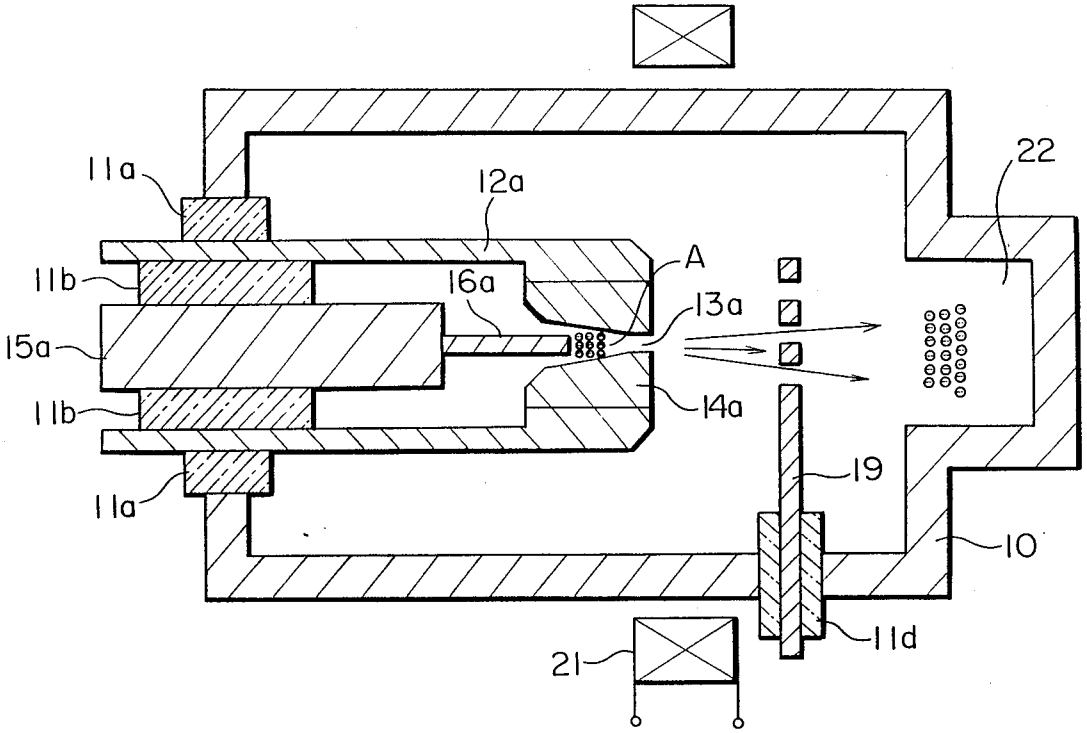
FIG. 5 is a schematic view of the apparatus for generating a negatively charged species in accordance with still another embodiment of the present invention.
Figure 6:
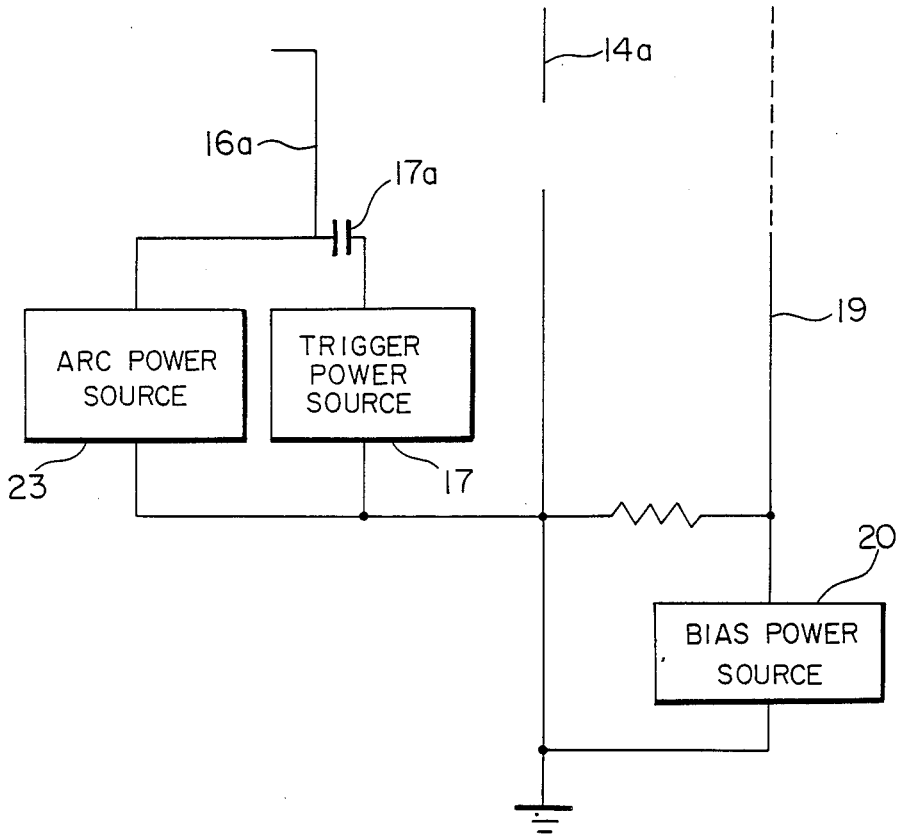
FIG. 6 is a circuit diagram of the apparatus shown in FIG. 5.

FIG. 5 is a schematic view of an apparatus for generating a negatively charged species in accordance with another embodiment of the present invention, while FIG. 6 is a circuit diagram of the apparatus shown in FIG. 5. In these drawings, the components designated by the same reference numerals as these shown in FIG. 2 denote identical or corresponding components. An electrically conductive member 12*a* having a cylindrical shape including a bottom is supported by insulating support members 11*a*, 11*b* mounted in the box-shaped vacuum vessel 10. A copper cathode 14*a* is installed at a peripheral edge portion of a hole 13*a* in member 12*a* is installed at a peripheral edge portion of a hole 13*a* for the passage of a negatively charged species. Hole 13*a* is formed in a central portion of a bottom surface of the conductive member 12*a*. An inner wall surface of this cathode 14*a* has a tapered shape. A tip of a copper anode 16*a* having a bar shape installed at a tip of a conductive rod 15*a* and supported by an insulating support 11*b* mounted in the vacuum vessel 10 faces this inner wall surface.

In the apparatus for generating a negatively charged species in accordance with this embodiment, a discharge is started between the cathode 14*a* and the anode 16*a* using the high voltage trigger power source 17 which is electrically connected to the cathode 14*a* and the anode 16*a*. An arc discharge takes place between the anode 16*a* and the cathode 14*a*. In this case, a high voltage is generated when a capacitor 17*a* undergoes dielectric breakdown so that no trigger electrode is needed to start the discharge. The inner wall of cathode 14*a* is tapered so that the inner diameter becomes smaller toward the negatively charged species accumulating section 22. The tip portion of the bar-shaped anode 16*a* faces the inner wall surface of the cathode 14*a*. Accordingly, the negatively charged species converge on the side of the inner wall surface of the cathode 14*a*. The converged negatively charged species can be drawn out effectively with good directivity from the arc space A toward the negatively charged species accumulating section 22. Furthermore, there is another advantage in that the quantity of the negatively charged species generated can be controlled.

Figure 7:
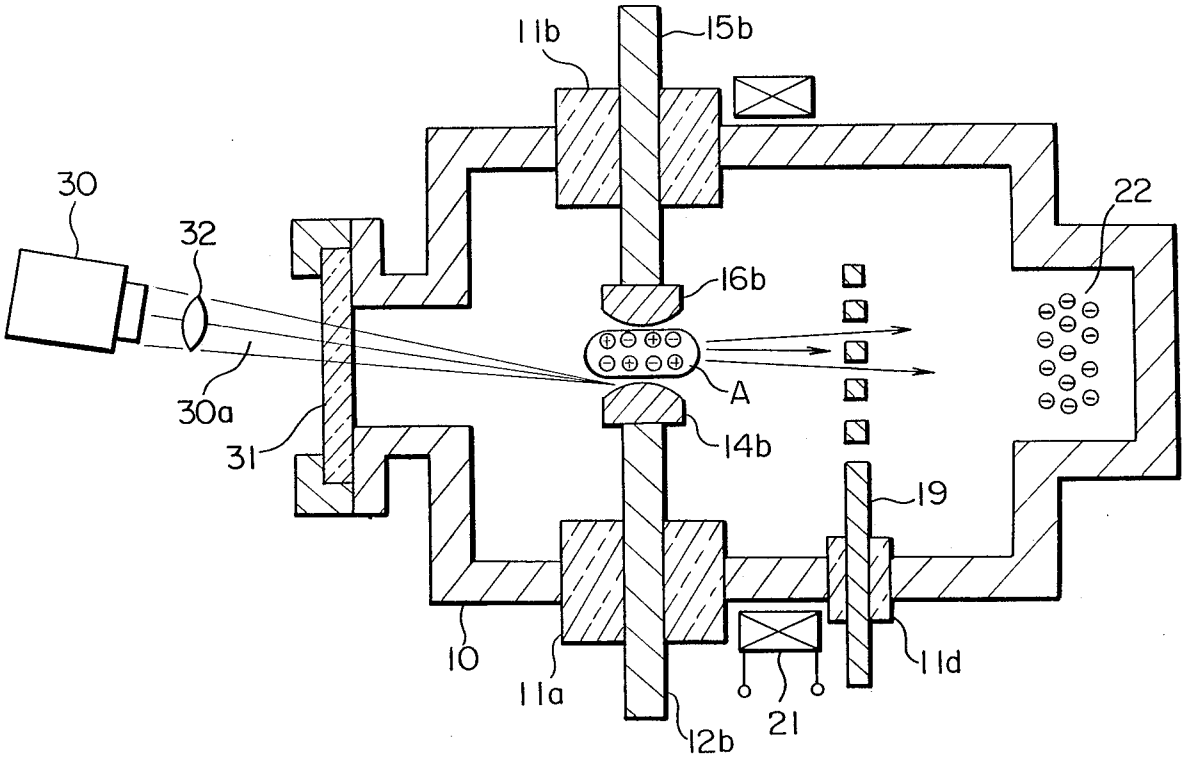
FIG. 7 is a schematic view of an apparatus for generating a negatively charged species in accordance with a further embodiment of the present invention.
Figure 8:
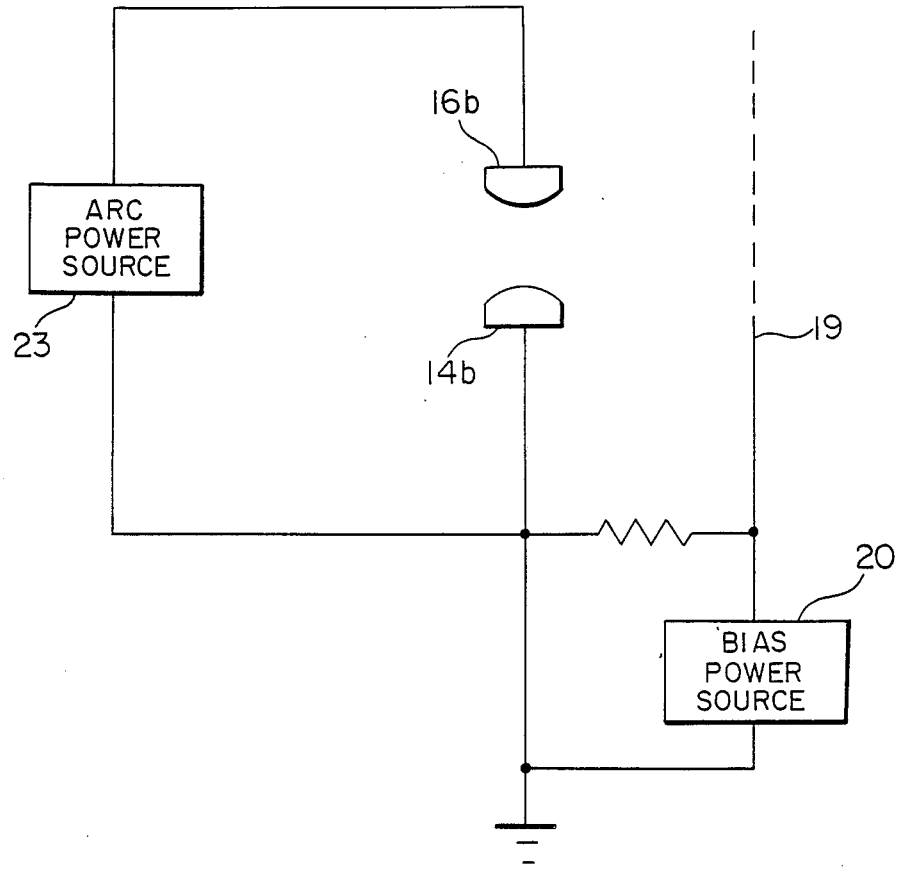
FIG. 8 is a circuit diagram of the apparatus shown in FIG. 7.

FIG. 7 illustrates a schematic view of the apparatus for generating a negatively charged species in accordance with still another embodiment of the present invention, while FIG. 8 is a circuit diagram of the apparatus shown in FIG. 7. In these drawings, the same reference numerals as those shown in FIG. 2 denote identical or corresponding components. A fixed laser generator 30 is disposed outside the vacuum vessel 10, and a laser beam transmission window 31 is provided in a wall of the vacuum vessel 10. A laser beam 30*a* from laser 30 is introduced into the interior of the vacuum vessel 10 through a condenser lens 32 and window 31.

In the apparatus for generating a negatively charged species in accordance with this embodiment, the laser beam 30*a* is generated by the laser generator 30. After being condensed by the lens 32, the high energy laser beam 30*a*, in pulse form, impinges on the surface of the cathode 14*b* in the vacuum vessel 10. Thus, a discharge is started in the vicinity of a cathode 14*b*. As a result of this discharge, an arc discharge takes place between the anode 16*b* and the cathode 14*b*.

Figure 9:
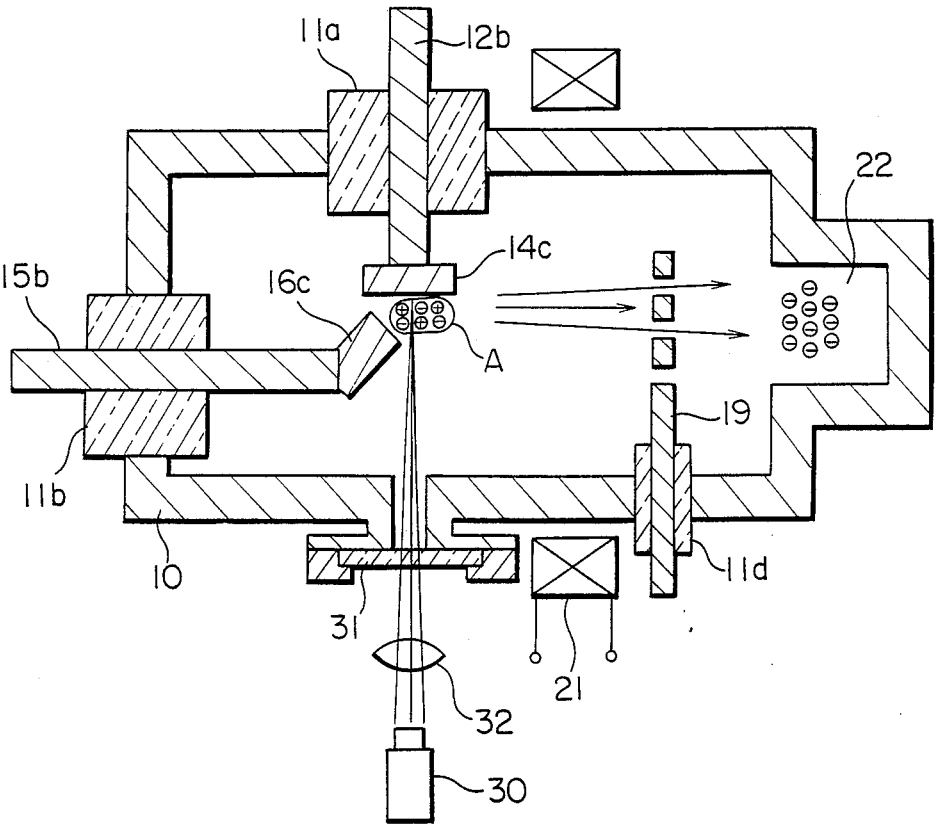
FIG. 9 is a schematic view of the apparatus for generating a negatively charged species in accordance with a still further embodiment of the present invention.

Although, in the foregoing embodiment, an example has been shown in which the laser beam 30*a* is condensed onto the surface of the cathode 14*b*, the laser beam 30*a* may be condensed onto the surface of the anode 16*b*. In addition, as shown in FIG. 9, the laser beam transmission window 31 may be disposed facing a cathode 14*c*, and an anode 16*c* may be inclined relative to the cathode 14*c* opposite the grid 19.

What is claimed is:

1. An apparatus for generating charged species comprising:

a vacuum vessel;

an anode having a central axis and disposed in said vacuum vessel;

a cylindrical cathode having a central axis and a bottom wall including a generally axially aligned opening, said cylindrical cathode being disposed in said vacuum vessel coaxially with and surrounding said anode, said opening being generally aligned with said anode;

a cylindrical trigger electrode having a central axis and a bottom wall including a generally axially aligned opening disposed in said vacuum vessel coaxially with and between said anode and said cathode, the opening in said bottom wall of said trigger electrode being disposed opposite said anode, for initiating an arc between said anode and cathode;

a grid disposed in said vacuum vessel opposite said cathode for accelerating charged species formed in the arc between said anode and cathode; and an electromagnetic coil disposed outside said vacuum vessel for producing a magnetic field in said vacuum vessel having an axis aligned with the central axes of said anode and cathode for converging charged species produced in the arc.

2. An apparatus according to claim 1 wherein said vacuum vessel includes a charged species accumulating region disposed opposite said grid and on the opposite side of said grid from said cathode for accumulating charged species generated in the arc.

3. An apparatus according to claim 1 wherein one of said cathode and said anode is formed of at least one kind of metal selected from the group consisting of copper, titanium, aluminum, chromium, zirconium, molybdenum, tantalum, tungsten, lead, silver, and gold.

4. An apparatus according to claim 1 wherein one of said cathode and said anode is formed of a semiconductor such as silicon or germanium.

5. An apparatus according to claim 1 wherein one of said cathode and anode is formed of a metal such as titanium in which a gas such as hydrogen or argon is occluded.

6. An apparatus for generating charged species comprising:

a vacuum vessel;

an anode having a central axis and disposed in said vacuum vessel;

a cathode having a central axis and disposed in said vacuum vessel spaced from and opposite said anode, the axes of said anode and cathode being aligned with each other;

a trigger electrode having a central axis and disposed in said vacuum vessel proximate said anode and cathode for initiating an arc between said anode and cathode, the central axis of said trigger electrode lying generally transverse to the central axes of said anode and cathode;

a grid disposed in said vacuum vessel opposite said trigger electrode for accelerating charged species formed in the arc between said anode and cathode, said anode and cathode being disposed between said trigger electrode and said grid; and an electromagnetic coil disposed outside said vacuum vessel for converging charged species produced in the arc and accelerated by said grid.

7. An apparatus according to claim 6 wherein said vacuum vessel includes a charged species accumulating region disposed opposite said grid and on the opposite side of said grid from said cathode for accumulating charged species generated in the arc.

8. An apparatus according to claim 6 wherein one of said cathode and said anode is formed of at least one kind of metal selected from the group consisting of copper, titanium, aluminum, chromium, zirconium, molybdenum, tantalum, tungsten, lead, silver, and gold.

9. An apparatus according to claim 6 wherein one of said cathode and said anode is formed of a semiconductor such as silicon or germanium.

10. An apparatus according to claim 6 wherein one of said cathode and said anode is formed of a metal such as titanium in which a gas such as hydrogen or argon is occluded.

11. An apparatus for generating charged species comprising:

a vacuum vessel;

an anode having a central axis and disposed in said vacuum vessel;

a cylindrical cathode having a central axis and disposed in said vacuum vessel coaxially with and surrounding said anode, said cathode including an opening proximate said anode for the passage of charged species generated in an arc between said anode and cathode;

a grid disposed in said vacuum vessel opposite said cathode for accelerating charged species formed in the arc between said anode and cathode; and an electromagnetic coil disposed outside said vacuum vessel for producing a magnetic field in said vacuum vessel having an axis aligned with the central axes of said anode and cathode for converging charged species produced in the arc wherein the opening in the cathode tapers to a smaller cross-sectional area in the direction from said anode toward said grid.

12. An apparatus according to claim 11 wherein said vacuum vessel includes a charged species accumulating region disposed opposite said grid and on the opposite side of said grid from said cathode for accumulating charged species generated in the arc.

13. An apparatus according to claim 11 wherein one of said cathode and said anode is formed of at least one kind of metal selected from the group consisting of copper, titanium, aluminum, chromium, zirconium, molybdenum, tantalum, tungsten, lead, silver, and gold.

14. An apparatus according to claim 11 wherein one of said cathode and said anode is formed of a semiconductor such as silicon or germanium.

15. An apparatus according to claim 11 wherein one of said cathode and said anode is formed of a metal such as titanium in which a gas such as hydrogen or argon is occluded.

16. An apparatus for generating charged species comprising:

a vacuum vessel;

an anode having a central axis and disposed in said vacuum vessel;

a cathode having a central axis and disposed in said vacuum vessel spaced from and opposite said anode, the axes of said anode and cathode being aligned with each other;

a laser disposed outside said vacuum vessel for illuminating one of said cathode and anode for initiating an arc discharge between said anode and cathode;

a grid disposed in said vacuum vessel opposite said cathode for accelerating charged species formed in the arc between said anode and cathode; and an electromagnetic coil disposed outside said vacuum vessel for producing a magnetic field in said vacuum vessel for converging charged species produced in the arc and accelerated by said grid.

17. An apparatus according to claim 16 wherein said vacuum vessel includes a charged species accumulating region disposed opposite said grid and on the opposite side of said grid from said cathode for accumulating charged species generated in the arc.

18. An apparatus according to claim 16 wherein one of said cathode and said anode is formed of at least one kind of metal selected from the group consisting of copper, titanium, aluminum, chromium, zirconium, molybdenum, tantalum, tungsten, lead, silver, and gold.

19. An apparatus according to claim 16 wherein one of said cathode and said anode is formed of a semiconductor such as silicon or germanium.

20. An apparatus according to claim 16 wherein one of said cathode and said anode is formed of a metal such as titanium in which a gas such as hydrogen or argon is occluded.

21. An apparatus according to claim 16 comprising a condensing lens for condensing light produced by said laser and a transmission window disposed on a wall of said vacuum vessel for transmission of the laser light to one of said anode and cathode.

22. An apparatus according to claim 21 wherein said transmission window is disposed opposite said cathode and said anode is inclined relative to said cathode.

* * * * *